US009062405B2

(12) United States Patent
Yoon et al.

(10) Patent No.: US 9,062,405 B2
(45) Date of Patent: Jun. 23, 2015

(54) DRUM TYPE WASHING MACHINE AND METHOD FOR FABRICATING DRUM THEREFOR

(75) Inventors: Jong Sun Yoon, Jinju-si (KR); Chang Woo Son, Gimhae-si (KR); Jae Cheol Lyu, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1634 days.

(21) Appl. No.: 11/660,697

(22) PCT Filed: May 22, 2006

(86) PCT No.: PCT/KR2006/001917

§ 371 (c)(1),
(2), (4) Date: Nov. 20, 2008

(87) PCT Pub. No.: WO2006/126814

PCT Pub. Date: Nov. 30, 2006

(65) Prior Publication Data

US 2009/0133447 A1 May 28, 2009

(30) Foreign Application Priority Data

May 23, 2005 (KR) ..... 10-2005-0043180
Sep. 30, 2005 (KR) ..... 10-2005-0092364

(51) Int. Cl.
*D06F 37/06* (2006.01)
*D06F 37/02* (2006.01)
*D06F 37/04* (2006.01)

(52) U.S. Cl.
CPC ..... *D06F 37/06* (2013.01); *D06F 37/02* (2013.01); *D06F 37/04* (2013.01)

(58) Field of Classification Search
CPC ..... D06F 37/06
See application file for complete search history.

(56) References Cited

U.S. PATENT DOCUMENTS 3,034,226 A * 5/1962 Conlee ..... 34/596
5,417,097 A * 5/1995 Kojima et al. ..... 72/335

(Continued)

FOREIGN PATENT DOCUMENTS

CN 2443979 8/2001
CN 1414163 4/2003

(Continued)

OTHER PUBLICATIONS

Australian Office Action dated Feb. 16, 2009.

(Continued)

*Primary Examiner* — Michael Barr
*Assistant Examiner* — Jason Riggleman
(74) *Attorney, Agent, or Firm* — Ked & Associates, LLP

(57) ABSTRACT

A drum type washing machine and a method for fabricating a drum thereof are provided. The drum type washing machine includes a motor, a drum having a drum center of a cylinder shape and a drum back connected to an opening formed in a side of the drum center to define a rear surface of the drum, a connector mounted in the rear surface of the drum, and a rotation shaft connected to the connector to transmit a rotation force of the motor to the drum. The drum back is formed in a bowl shape to have a drum expanding part expanding toward an outer side of the drum from the opening of the drum center, and a portion of the drum back where the connector is mounted is recessed toward an inside of the drum to reduce a distance between the drum center and the connector.

17 Claims, 10 Drawing Sheets

(56) References Cited

U.S. PATENT DOCUMENTS

| | | | | |
|---|---|---|---|---|
| 5,746,070 | A | 5/1998 | Bailey et al. | |
| 7,096,695 | B2 * | 8/2006 | No et al. | 68/58 |
| 2003/0074932 | A1 * | 4/2003 | No et al. | 68/58 |
| 2005/0229651 | A1 * | 10/2005 | Ahn | 68/139 |

FOREIGN PATENT DOCUMENTS

| | | | | | |
|---|---|---|---|---|---|
| CN | 1414163 | A | * | 4/2003 | D06F 39/02 |
| CN | 1576443 | | | 2/2005 | |
| EP | 1 498 536 | A2 | | 1/2005 | |
| EP | 1 502 982 | A2 | | 2/2005 | |
| EP | 1505982 | | | 2/2005 | |
| EP | 1 306 479 | B1 | | 12/2006 | |
| GB | 1385731 | | | 3/1975 | |
| GB | 1388731 | A | * | 3/1976 | D06F 37/02 |
| GB | 2332212 | A | * | 6/1999 | D06F 37/30 |
| JP | 2000-254384 | | | 9/2000 | |
| JP | 2003-126595 | | | 5/2003 | |
| JP | 2004-129994 | | * | 4/2004 | D06F 37/12 |
| JP | 2004-194876 | | | 7/2004 | |
| JP | 2005-046630 | | | 2/2005 | |
| KR | 10-2003-0034504 | | | 5/2003 | |
| KR | 20030034504 | A | * | 5/2003 | D06F 37/06 |
| KR | 10-2003-0060550 | A | * | 7/2003 | D06F 37/06 |
| KR | 10-2003-0060551 | | | 7/2003 | |
| KR | 1020030060551 | A | * | 7/2003 | D06F 37/04 |
| WO | WO 2004/109004 | | | 12/2004 | |
| WO | WO 2005/100672 | | | 10/2005 | |

OTHER PUBLICATIONS

Chinese Office Action dated Oct. 23, 2009.
Japanese Office Action dated Jan. 18, 2011. (Application No. 2008-513361).
Korean Notice of Allowance dated Apr. 7, 2013.
Eurpoean Search Report dated May 15, 2014.

* cited by examiner

DRUM TYPE WASHING MACHINE AND METHOD FOR FABRICATING DRUM THEREFOR

TECHNICAL FIELD

The present invention relates to a drum type washing machine, and more particularly, to a drum type washing machine and a method for fabricating a drum therefore, where a drum suitable for a large capacity is supplied by improving a structure thereof and a method for fabricating the same even without enlarging the exterior size of the drum type washing machine.

BACKGROUND ART

In generally, a washing machine is an appliance used in a house most commonly, which washes clothes, cloth item, articles of clothing and beddings (hereinafter, the laundry) and removes dirt of the laundry by using impact of water, chemical action of detergent and friction force between water current and the laundry through a washing, rinsing and spinning cycle.

The washing machine is, classified into an agitator type washing machine, a pulsator type washing machine and a drum type washing machine. The agitator type washing machine and the pulsator type washing machine have a drum standing vertically, and the drum type washing machine has a drum standing horizontally.

The agitating type washing machine performs washing by using a beating effect created in agitating a washing pole provided in a center of a tub in a right- and left-direction, whereas the pulsator type washing machine performs washing by using a friction force between the laundry and water current caused in agitating a pulsator of a circular plate shape formed in a lower portion of a tub in a right-and-left-direction. The drum type washing machine performs washing by using impact created owing to the drop of the laundry and chemical action of detergent once the laundry, washing water and the detergent are mixedly loaded into a drum having plural lifters projected.

As well-known in the related art, according to the conventional drum type washing machine, a tub holding wash water therein is mounted within a cabinet defining an exterior of the drum type washing machine. Also, a drum having the laundry loaded therein is mounted within the tub and a motor rotating the drum is mounted in rear of the tub. A rotation shaft is hingedly connected to a rear side of the drum with passing through the tub.

Recently, demands for the drum type washing machine have been increasing accordingly, because water consumption, fabric damage and laundry entanglement are much less in the drum type washing machine than in the pulsator washing machine. Moreover, since the drum type washing machine may be adapted to be built-in or be installed as requested by a user, for example, in the kitchen sink and the drum type washing machine is preferred owing to the recent consumption trend, the popularity and the demand for theme have been drastically increasing.

Together with that, although a drum type washing machine with the capacity of 6 to 8 kg has been released a lot, the drum capacity has been getting bigger according to the user wish that he/she wishes to wash bigger beddings or bigger laundries at one time. Especially, a drum type washing machine with a 13 kg drum is popular in the North America and it can be said that a drum type washing machine which was thought as one with small capacity has been getting bigger and bigger.

The drum type washing machine with a bigger capacity accompanies a bigger drum. That is why the capacity of the drum type washing machine is determined by a drum size.

However, it is neither technically nor economically easy to increase the drum size by only increasing a diameter or length of a drum. If the diameter or the length of the drum is increased, a diameter or a length of a tub should be increased, considering the collision between the drum and the tub. Thus, a size of a cabinet should be increased, thereby causing a problem of high production cost and a big size of the whole washing machine bigger than necessary.

That is, although there may be spare room to prevent the collision between the tub and the drum, it is not easy to enlarge a drum size in the same exterior of the conventional drum type washing machine.

Also, it is necessary in reducing the production cost to apply a bigger drum to various parts needed in manufacturing a drum, because the production cost may be increasing as much as extraordinary components which are different from the existing components are needed.

It can be confirmed in a process of developing a drum type washing machine that to enlarge the capacity of the drum type washing machine is not easy. Although European washing machine manufacturers had conquered the international washing machine market until the mid 90'es, their capacity of the drum type washing machine had been limited to 6 kg. That is why a motor of their drum type washing machine fails to control the number of the speed and space for a clutch and a belt is needed.

That is, the conventional drum type washing machine can make the laundry damaged less even with less wash water and enlarging the capacity thereof is limited by the various conditions.

DISCLOSURE OF INVENTION

Technical Problem

An object of the present invention devised to solve the problem is to provide a drum type washing machine which can secure a larger capacity than the conventional drum type washing machine with a large capacity without the change of an exterior drum size.

Another object of the present invention devised to solve the problem is to provide a drum type washing machine which can enlarge the drum capacity through only changing the least configuration.

A further object of the present invention devised to solve the problem is to provide a drum type washing machine which can control vibration and secure strength of a spider fastening part even as enlarging a drum capacity by improving the structure of the drum capable of determining laundry washing capacity.

In other words, the present invention nay maintain the strength of the drum and the exterior size of the conventional drum type washing machine with a large capacity, and may allow many parts such as a drum center used in public with the enlarged washing capacity.

The object of the present invention can be achieved by providing a drum type washing machine.

In another aspect of the present invention, provided herein is a method for fabricating a drum for a drum type washing machine.

Technical Solution

To achieve these objects and other advantages and in accordance with the purpose of the invention, as embodied and broadly described herein, a drum type washing machine includes a motor, a drum having a drum center of a cylinder shape and a drum back connected to an opening formed in a side of the drum center to define a rear surface of the drum, a connector mounted in the rear surface of the drum, and a rotation shaft connected to the connector to transmit the rotation force of the motor to the drum, wherein the drum back is formed in a bowl shape to have a drum expanding part expanded toward an outer side of the drum from the opening of the drum center and a portion of the drum back where the connector is mounted is recessed toward the inside of the drum to reduce the distance between the drum center and the connector.

Here, the distance between the drum center and the connector is very important in determining the entire exterior size of the drum type washing machine, especially the front-and-rear width, because the distance between the drum center and the connector is increased and accordingly the drum capacity is increase, thereby increasing the front-and-rear width of the drum type washing machine.

However, to make the front-and-rear width of the drum type washing machine according to the present invention the same as that of the drum type washing machine of the related art, it is preferred that the portion of the drum back where the connector is mounted is recessed toward the inside of the drum to reduce the distance between the drum center and the connector.

An internal diameter of the drum center is the same as an internal diameter of a circumference of the drum back connected to the opening formed in a side of the drum. The circumference of the drum back may include a linear part with a predetermined length which is parallel with the center shaft of the drum.

That is, it is preferred that the drum center and the drum back are not connected perpendicularly. In other words, it is more advantageous to block the bottom of the cylindrical shape with a curved surface in a bowl shape than with a plane surface.

If the distance to the rear surface of the drum back (the end of the drum expanding part) is regular, the circumference of the drum back may include a linear part with a predetermined length which is parallel with the center shaft of the drum That is because the capacity of the expanding part can be increased by the linear part.

Preferably, the circumference of the drum back and the rear surface of the drum back are formed in a round shape to facilitate the recessed part where the connector is mounted. Also, that is because the dampened laundry tends to be layered and fabric damage may be lessened in a round shape less than in a square shape.

Also, the round shape is to minimize the interference between the drum and the tub as well as to secure the tub capacity.

Preferably, the connector is a spider having plural leg parts in a radial direction. The spider may perform its function reliably as well as safely, because it has a fastening part (for example; a bolting part) for fastening the drum thereto and the leg part. However, it is not necessary that the connector is limited to the spider in the present invention.

A tub having a drum rotatably provided therein is further included and the tub has a tub expanding part having a rotation shaft passed through a rear surface thereof and having some of the rear surface expanded backwardly.

The motor may be mounted in the rear surface of the tub to be connected to the rotation shaft, and a portion of the rear surface of the tub where the motor is not mounted is expanded backwardly enough to form the tub expanding part. That is, it is preferred that the expanding part is formed in the tub with corresponding to the expanding part in the drum.

Here, the tub may be inclinedly provided at a predetermined angle against a bottom of the drum type washing machine. Accordingly, the drum mounted within the tub may be inclinedly provided at a predetermined angle as corresponding thereto.

Preferably, the drum is made of stainless, and the thickness of the drum front and of the drum center is 0.5 mm and the thickness of the drum back is 1 mm. also preferably, the ratio (d/D) of the drum back depth (d) to the drum diameter (D) is 0.08~0.2.

Here, the drum back depth means the distance expanded at most from the circumference of the drum back.

The ratio of the drum back depth (d) to the drum center length (L2) may be 0.18~0.36. The ratio of the drum front length (L1) to the drum center length (L2) to the drum back depth (d) (L1:L2:d) may be 1:8.3:1.5~1:9.7:2.7. Also, the internal diameter of the drum center is formed within the range of 500~600 mm.

A lifter of a triangle shape getting wider from a front portion toward a rear portion is provided within the drum, and the lifter includes a ball installing part formed along a center portion of the lifter in a front-and-rear direction, the ball installing part projectedly formed from the lower surface of the lifter to make the width thereof narrower than the lower surface of the lifter, an oblique surface of a S-shape formed in rear of the opposite sides of the ball installing part, the oblique surface connected to an upper surface of the ball installing part from the lower surface of the lifter, a ball rotatably mounted on the ball installing part, and a wash-water-through-hole formed on the ball installing part.

A cabinet for forming an exterior thereof and a back cover for shutting off an access to a rear side of the drum from a rear surface of the cabinet are further included and the back cover has a projection part projected backwardly in an upper portion thereof. Generally, the rear side of the conventional drum type washing machine is spaced apart in a predetermined distance with a wall, because the distance between the drum and the motor may be increased through the projected part of the back cover, without increasing the entire side thereof.

The drum further includes a drum front connected to the drum center to form the opening of the drum, and the drum front includes a front minimum internal diameter part, a rear maximum internal diameter part and an oblique part for connecting the front minimum internal diameter part and the rear maximum internal diameter part. Preferably, a drum front expanding part expanded forwardly is formed in the oblique part, because some portion of the outer oblique surface may be meaningless space in the relationship with the cabinet and the drum capacity may be increased instead of just lessening the meaningless space.

In another aspect of the present invention, a method for fabricating a drum for a drum type washing machine is included. The method for fabricating a drum for a drum type washing machine includes steps of: forming a drum back in a bowl shape with a predetermined part of a bottom thereof projected upwardly by pressing a parent material of a metal plate; trimming unnecessary portions to form a bowl shaped drum back; and piercing plural holes to allow wash water to pass there through except the projected portion of the bottom.

The method for fabricating a drum for a drum type washing machine further includes a step of forming plural spider fastening holes on the bottom after or together with the step of piercing plural holes to allow wash water to pass there through except the projected portion of the bottom.

Preferably, the method for fabricating a drum for a drum type washing machine further includes a step of removing a burr which remains after at least one of the piercing step and the spider fastening hole forming step.

A drum fabricated by the method for fabricating a drum for a drum type washing machine is provided.

Advantageous Effects

A drum type washing machine according to the present invention has an advantageous effect that the collision of the drum expanding part which might be generated in over-vibration of the drum may can be minimized, because the drum expanding part formed in the other portion of the rear part of the drum except the portion where the spider is provided and washing capacity is increased as much as expanded space by the drum expanding part, as well as because the tub expanding part is formed in the other portion of the rear part of the tub except the portion where the motor is provided.

Furthermore, the drum type washing machine according to the present invention has another advantageous effect that the expanded area of the drum expanding part may be secured as much as possible, because the internal diameter of the drum center is the same as the internal diameter of the drum back where the drum expanding part is formed.

Still further, the drum type washing machine according to the present invention has another advantageous effect vibration generated in the drum and the tub may be reduced, because the drum expanding part enhances the strength of the rear part of the drum and the tub expanding part enhances the strength of the rear part of the tub.

Still further, the drum type washing machine according to the present invention has another advantageous effect washing/rinsing efficiency may be improved, because some of the laundry is rotated along the spider recessed toward the inside of the drum under friction force.

That is, the drum type washing machine according to the present invention can secure larger washing capacity than the conventional drum type washing machine of the related art without any change of the exterior size thereof.

Still further, the drum type washing machine according to the present invention has another advantageous effect that many parts such as a drum center which places the center of the drum may be made in common use even with the increased capacity of the drum. Thereby, production cost in fabricating various drum type washing machines having various capacities may be reduced.

Therefore, according to the present invention, the drum type washing machine is provided which can increase the drum size without change of the exterior size thereof through the improvement of the drum structure and which can control vibration as well as secure the strength of the spider.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
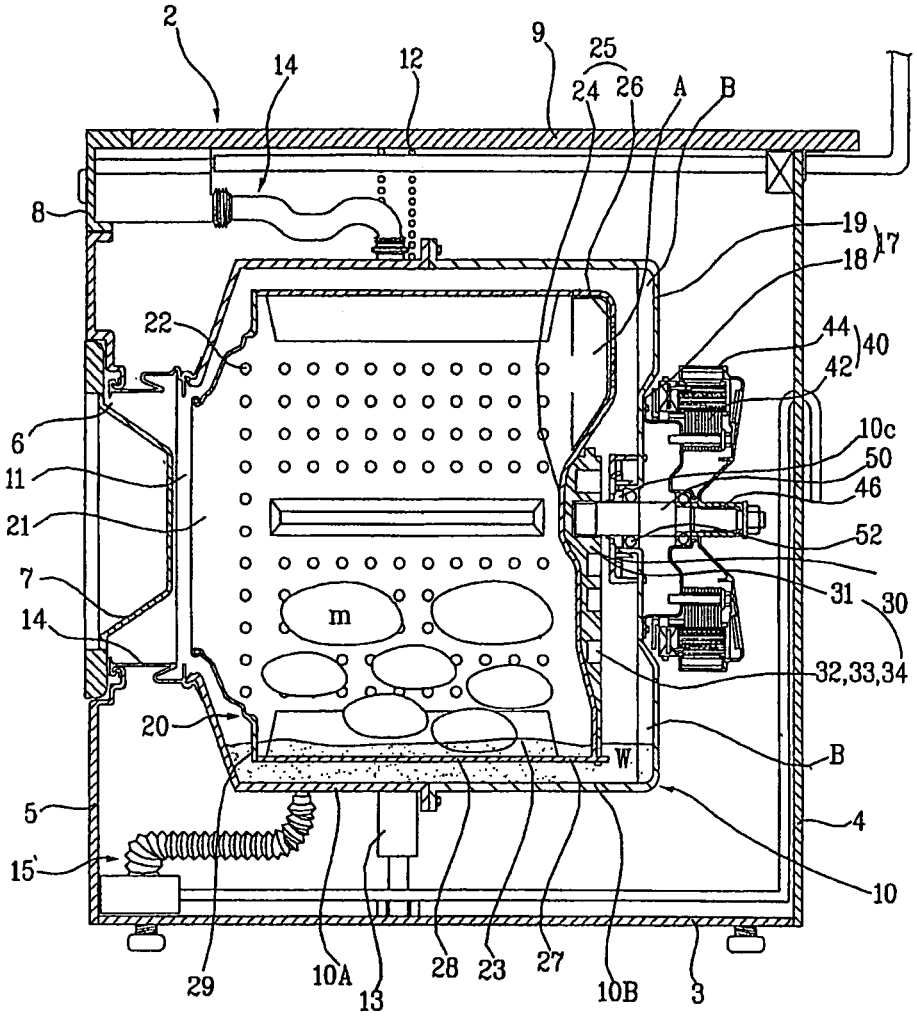
FIG. 1 is a sectional view illustrating an embodiment of a drum type washing machine according to the present invention.
Figure 2:
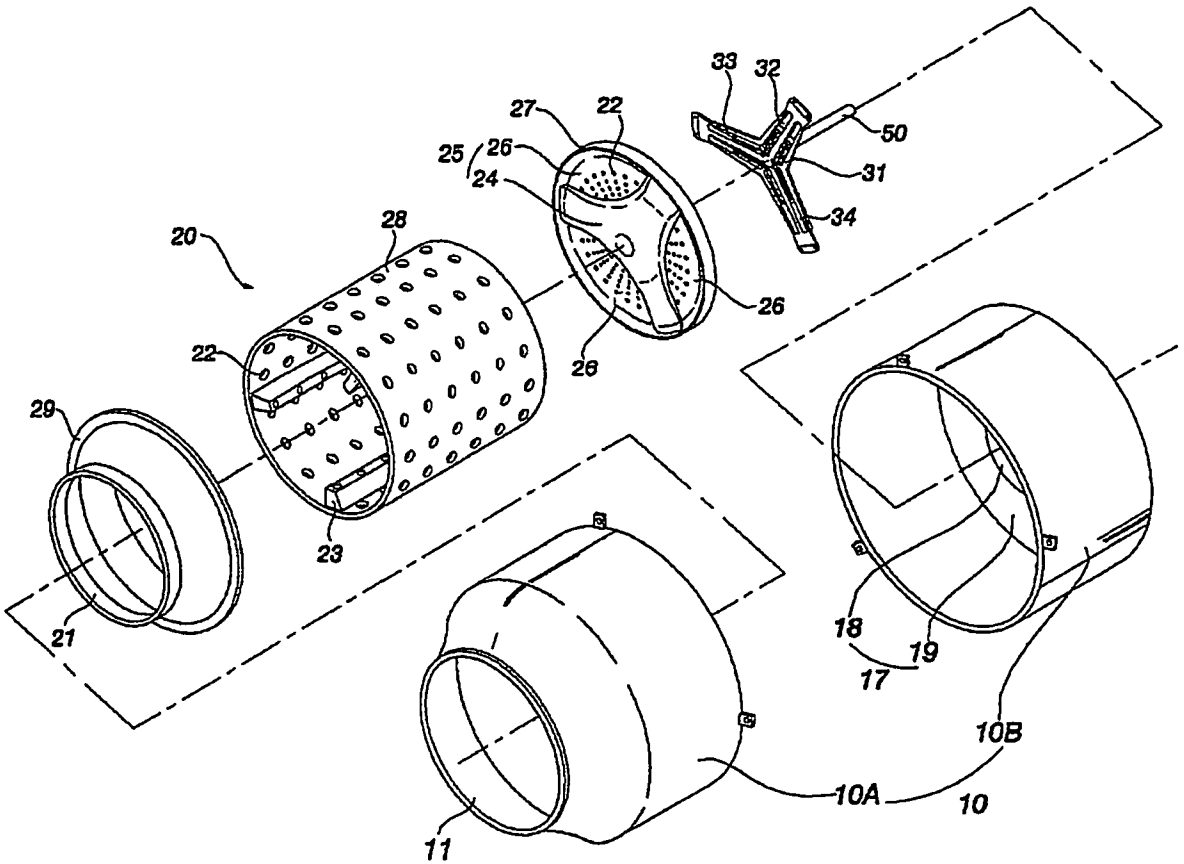
FIG. 2 is an exploded perspective view illustrating a tub and a drum of FIG. 1.

FIG. 1 is a sectional view illustrating an embodiment of a drum type washing machine according to the present invention. FIG. 2 is an exploded perspective view illustrating a tub and a drum of FIG. 1.

As shown in FIGS. 1 and 2, the drum type washing machine according to the present invention includes a tub 10 supported in a cabinet 2, a drum 20 rotatably mounted in the tub 10, a spider 30 mounted in a rear surface of the drum 20, a motor 40 mounted in the rear surface of the tub 10 and a rotation shaft 50 connected to the spider 30 with passing through the rear part of the tub 10.

The cabinet 2 includes a base 3, a cabinet body 4 mounted in an upper portion of the base 3, a cabinet cover 5 mounted in front of the cabinet body 4 and a top plate 9 mounted in an upper surface of the cabinet body 4.

An opening 6 is formed in the cabinet cover 5 to introduce the laundry (m) into the drum 20, and a door 7 is rotatably coupled to the cabinet cover 5 by hinge.

A control panel 8 is provided on an upper portion of the cabinet cover 5 or an upper surface of the top plate 9 to allow various cycle or time inputted therein.

Wash water (w) needed in washing or rinsing the laundry (m) is held within a lower portion of the tub 10 and the water collected in spinning the laundry (m) is held within the tub 10. The tub 10 is horizontal or inclined at a predetermined angle in a cylindrical shape, and also, an opening 11 formed in front of the tub 10 to introduce the laundry into the drum 20.

The tub 10 is connected to the cabinet body 4 by a spring 12, and connected to the base 3 by a damper 13, such that vibration may be dampened.

Also, a gasket 14 is connected to the tub 10 to prevent the laundry and wash water (w) from being leaked between the cabinet cover 5 and the door 7.

Furthermore, a tub expanding part 19 is formed in the tub 10, which is expanded backwardly in a portion of the rear surface 17 of the tub 10 except the portion where the motor 40 is mounted.

The tub expanding part 19 is stepped in the rear part 17 to minimize the collision with a drum expanding part, which will be described later, and to enhance the strength of the rear part 17 of the tub 10.

Meanwhile, the tub 10 includes a front tub 10A having an opening 11 in front thereof and a rear side opened, and a back tub 10B fastened in rear of the front tub 10A and having a front side opened. The tub expanding part 19 is recessed backwardly in the rear part 17 of the back tub 10B.

The front tub 10A and the back tub 10B are injection-molded with plastic.

The drum 20 is horizontal or inclined at a predetermined angle in a cylindrical shape. The drum 20 has an opening 21 formed in a center of the front side thereof to introduce the laundry (m) or wash water (w) there through and a through-hole 22 formed in a circumferential surface or in a rear surface to introduce wash water (w) there through and a lifter 23 mounted in an inner circumferential surface thereof to lift the laundry, which will be dropped later.

The drum 20 is made of metal such as stainless.

The drum 20 includes a drum back 25, a drum center 28, a drum front 29 and a drum expanding part 26. The drum back 25 defines a rear part of the drum 20. The drum center 28 has a rear end thereof fastened to the edge of the drum back 25 to define a circumference part of the drum 20 and has the lifter 23 mounted therein. Also, the drum front 29 is fastened to a front end of the drum center 28 to define a front part of the drum 20 and has the opening 21 formed thereon. The drum expanding part 26 is recessed backwardly from the drum back 25.

A forming part is formed in a portion of the drum 20 where the spider 30 is provided.

That is, the portion where the spider 30 of the drum back 25 is provided (hereinafter, a forming part) is formed by backwardly expanding and forwardly stepping a basic material of the drum 20 at the same time.

The forming part 24 is formed corresponding to the appearance of the spider 30, and formed a little bit larger than the spider 30 to allow the spider 30 inserted therein.

The forming part 24 is formed deep enough not to project the spider 30 toward the rear surface of the drum 20.

The drum expanding part 26 is backwardly expanded in a portion of the rear part of the drum 20 where the forming part 24 is formed.

Preferably, the drum expanding part 26 is formed in a rear part 25 of the drum 20 in plural, so that it may allow the size of the drum 20 be larger as well as to enhance the strength of the rear part 25 of the drum 20 and also may increase friction force of the laundry.

The plural drum expanding parts are formed, because the number of the forming part is corresponding to the number of the leg parts of the spider 30. That is, in case that the drum expanding part is formed between the leg parts adjacent to the spider 30, the drum expanding part 26 is formed in plural.

However, it is not limited thereto. The forming part 24 is formed to the inner surface of the drum center 28 in FIG. 1. However, if the depth of the forming is lessened, it can be said that one drum expanding part is formed. That is, in that case, all the space which the drum back 25 forms in rear of the drum center 28 may be called as a drum expanding part.

The spider 30 includes a hub part 31 having a front end of the rotation shaft 50 secured thereto and plural leg parts 32, 33 and 34 secured to the drum 20, especially the drum back 25, by fastening means such as a screw. The spider 30 is inserted into the forming part 24 in a rear direction of the drum back 25. The motor 40 includes a stator 42 secured in a center of a rear surface of the tub 10 and a rotor 44 rotated by electromagnetic force formed between the stator 42 and itself.

The stator 42 is fastened to the rear surface center 18 of the tub 10 in rear of the tub 10 by fastening means such as a screw.

A shaft fastening hole 46 having a rear end of the rotation shaft 50 fastened thereto is formed in the rotor 44.

The rotation shaft 50 passes through a through-hole 10C formed in a center of the tub 10, and a first end thereof is fastened to the hub part 31 of the spider 30 and a second end thereof is fastened to the shaft fastening hole 46.

The rotation shaft 50 is rotatably supported in the plural bearings 52 arranged in the opening 10C of the tub 10.

The reference A shown in FIG. 1 is the drum expanding space formed in the drum 20 and the reference B is the tub expanding space formed in the tub 10.

The reference number 14 shown in FIG. 1 is a water supply device which supplies wash water in which detergent is dissolved or clean wash water (w) in which detergent is not dissolved into the tub 10, and the reference number 15 is a water drainage device which drains the water extracted from the contaminated wash water within the tub 10 or from the laundry outside of the washing machine.

Operation of the present invention having the above configuration will be described.

First of all, as shown in FIG. 1, once the door 7 is opened and the laundry (m) is introduced into the drum 20, the laundry (m) is loaded within the drum 20 and some of the laundry is filled with the drum expanding space A. Thus, the washing machine may allow as much laundry as much space of the drum expanding space A loaded therein.

Once all of the laundry (m) which will be washed is introduced into the drum 20, the door 7 is closed. When a command on washing/rinsing/spinning is inputted through the control panel 8, the washing machine is operated based on the inputted command.

Once a washing cycle is inputted the water supply device 14 supplied wash water into the tub 10 and the wash water supplied into a lower portion of the tub 10 is drawn into the drum 20 through a through-hole 22 of the drum 20 to dampen the laundry (m).

Once a predetermined level of water is supplied into the tub 10, the water supply of the water supply device 14 is stopped and the motor 40 is turned on to rotate the spider 30 by using the rotation shaft 50.

While the spider 30 is being rotated, the drum 20 rotates to lift and drop the laundry and then dirt may be separated off the laundry by chemical action of wash water and detergent.

When the above washing is performed during the predetermined time, the motor 40 is off and the water drainage device 15 is operated to drain contaminated water outside.

If a rinsing cycle is inputted, the water supply device is operated and the motor 40 is on/off, and the water drainage device is operated to rinse the laundry, like the washing cycle. If a spinning cycle is inputted, the motor 40 is operated in a high speed to centrifugally spin and dehydrate the laundry.

Meanwhile, if the drum 20 is over-vibrated due to eccentricity of the laundry during the washing, rinsing and spinning cycle, the drum expanding part 26 of the drum 20 is getting closer to the rear part 17 of the tub 10 enough to cause a possibility of collision between the drum 20 and the tub 10. However, the tub 10 according to the present invention has the tub expanding part 19 and the tub expanding space B, such that the collision may not arise or the frequencies of the collision may be lessened.

Referring to FIGS. 3 to 10, another preferred embodiment of the present will be described.

Figure 3:
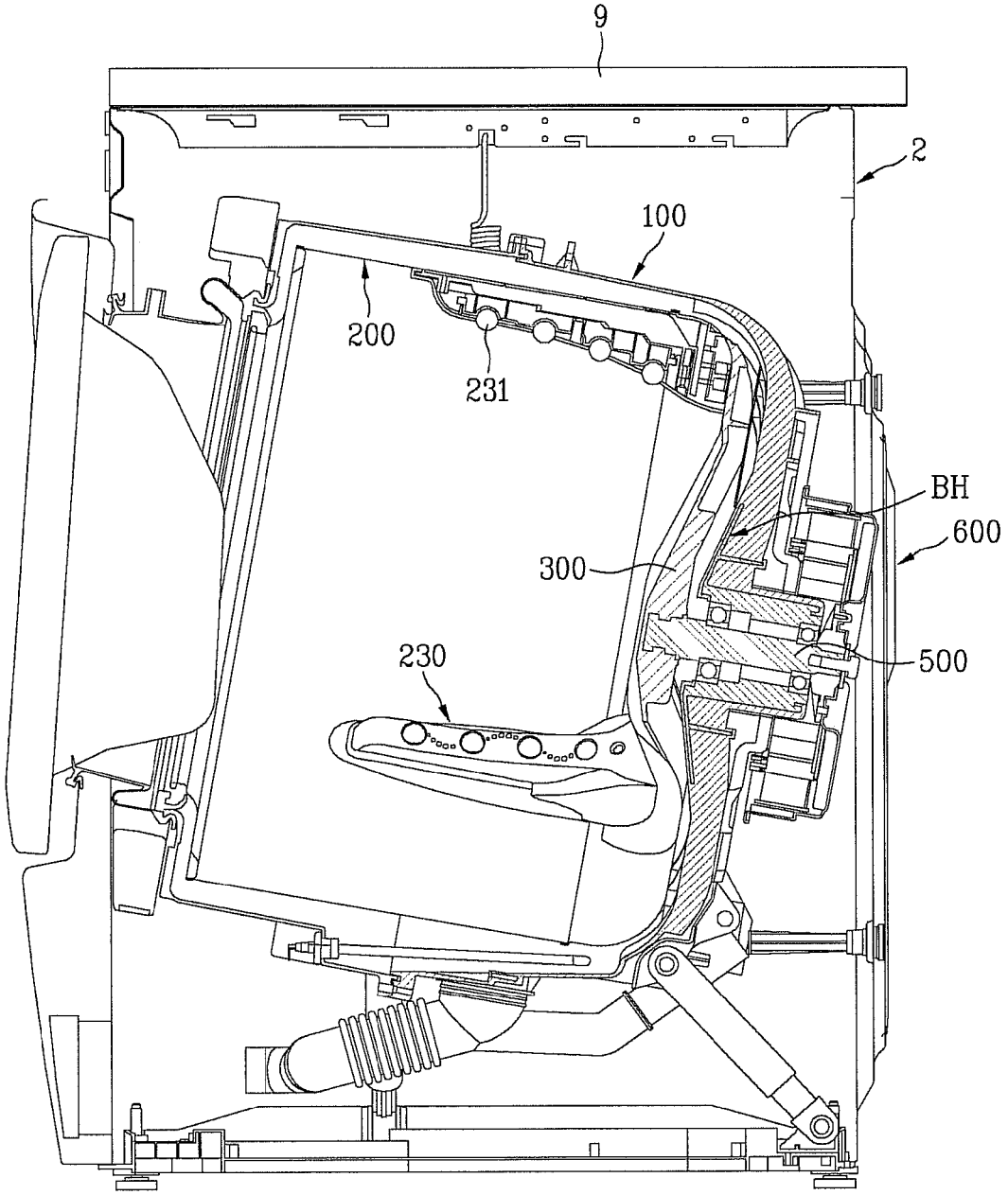
FIG. 3 is a sectional view illustrating another embodiment of the drum type washing machine according to the present invention.
Figure 4:
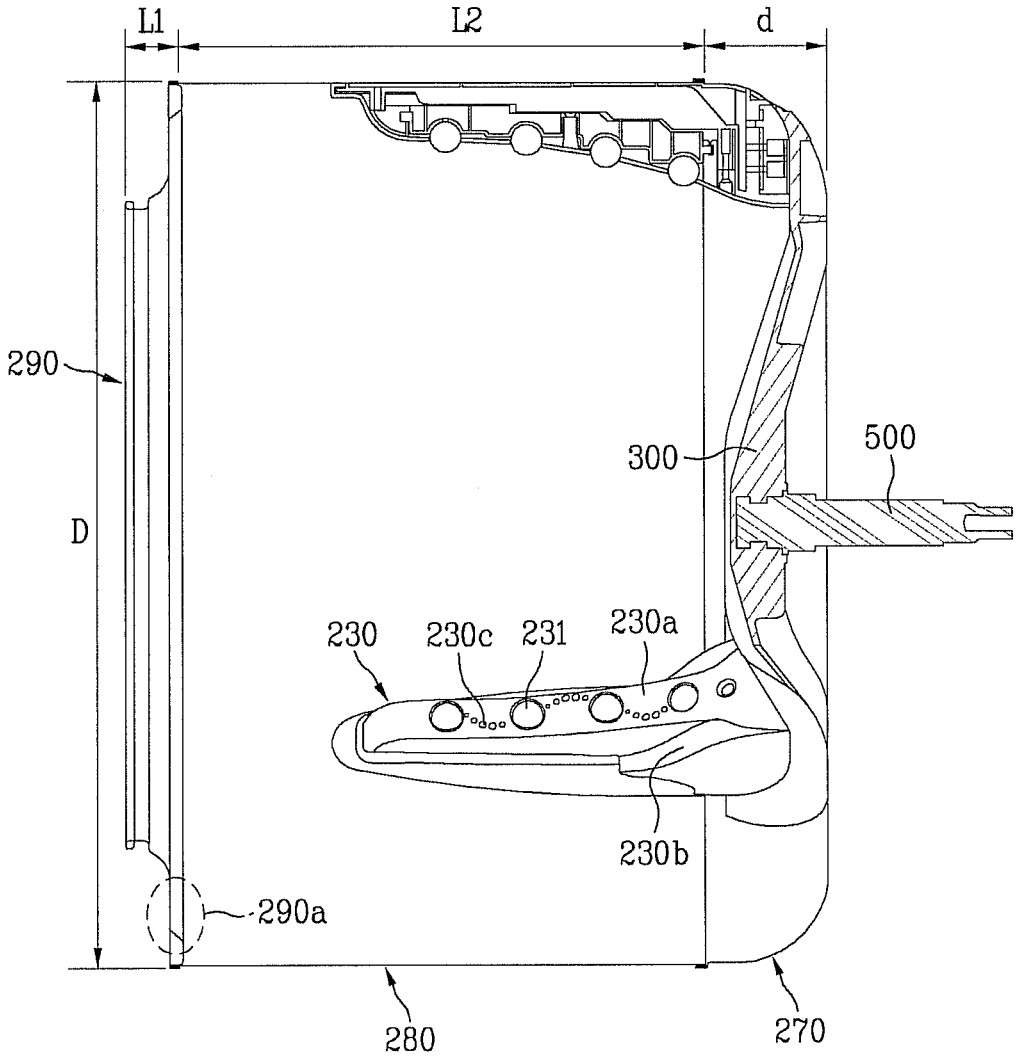
FIG. 4 is a sectional view illustrating a drum, a lifter and a spider of FIG. 3.
Figure 5:
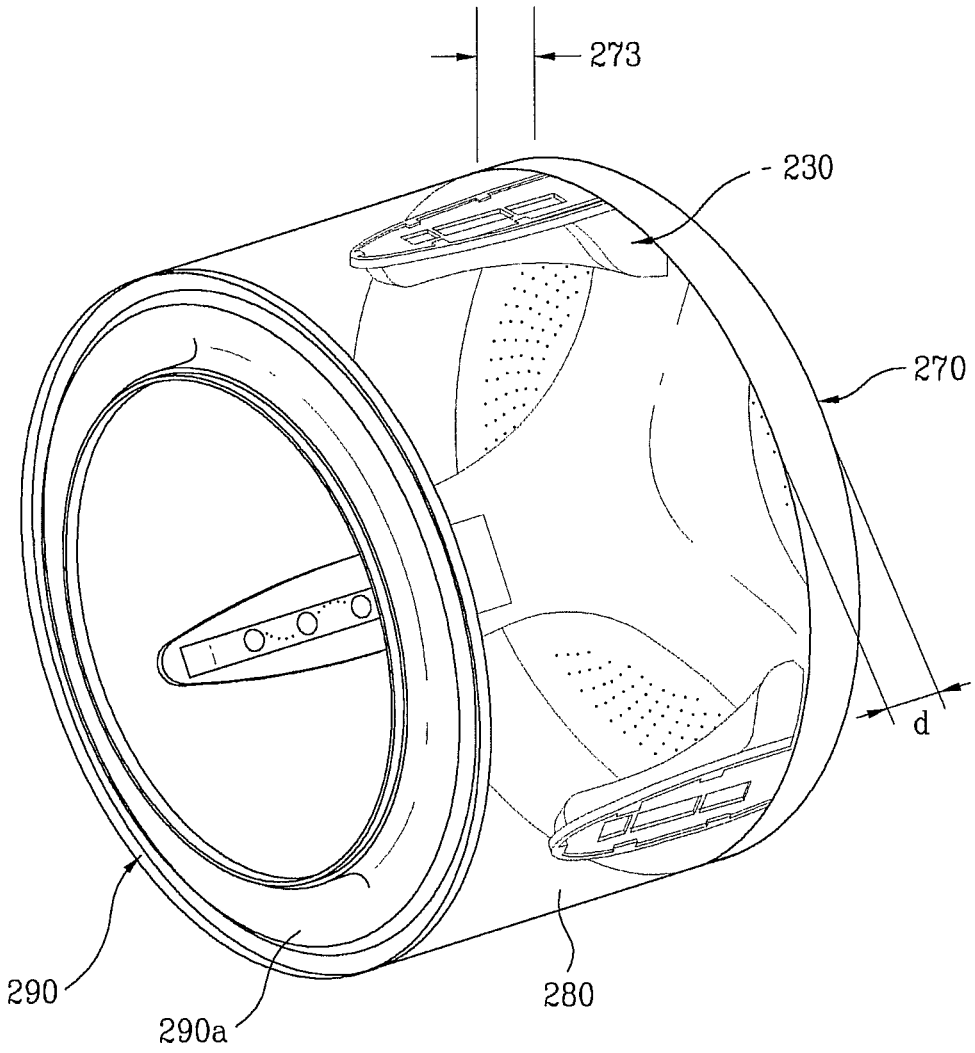
FIGS. 5 and 6 are perspective views of FIG. 4.
Figure 6:
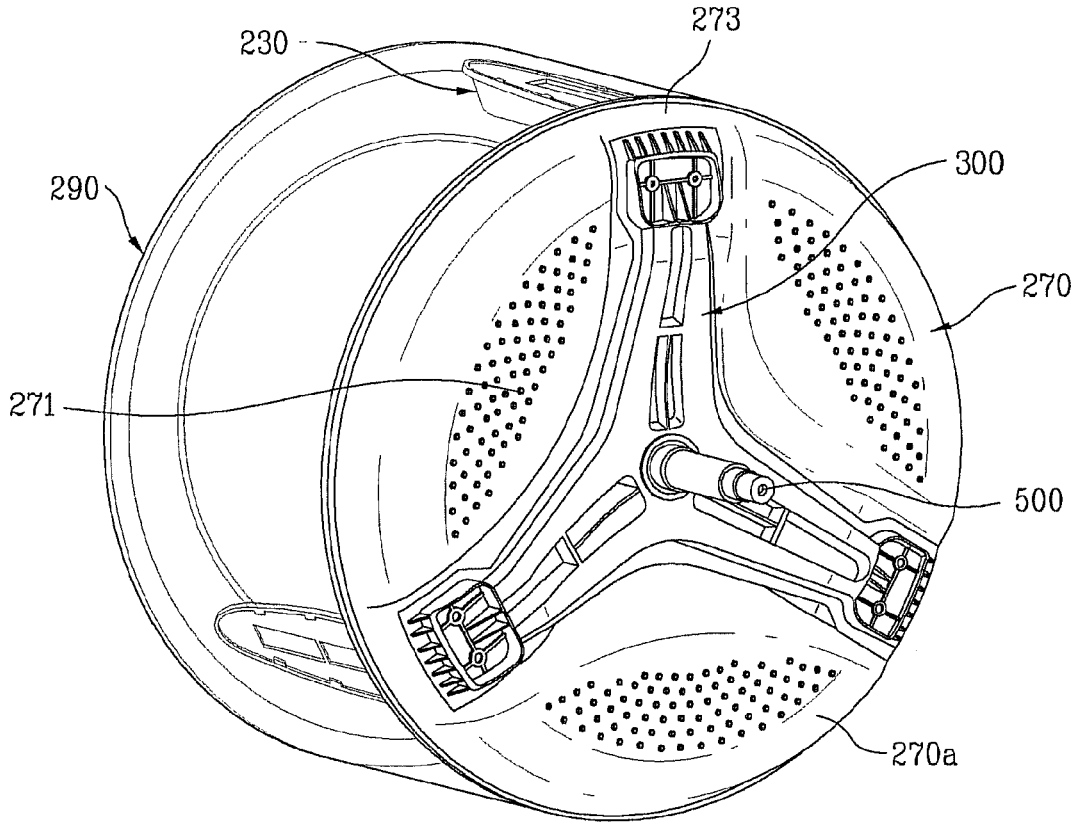

FIG. 3 is a sectional view illustrating another embodiment of the drum type washing machine according to the present invention. FIG. 4 is a sectional view illustrating a drum 200, a lifter 230 and a spider 300 of FIG. 3. FIGS. 5 and 6 are perspective views of FIG. 4.

Figure 7:
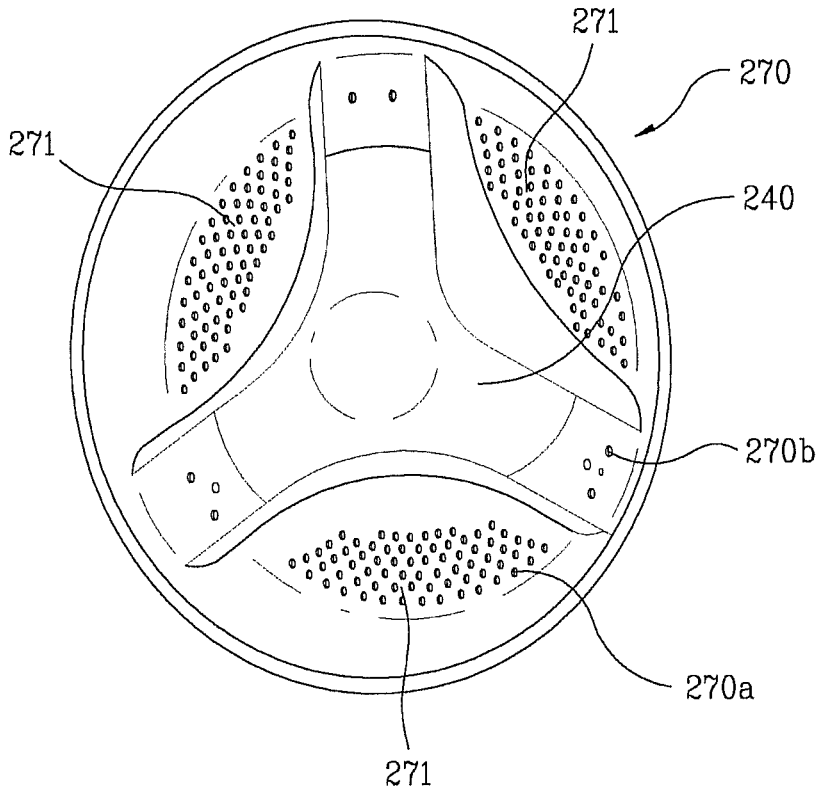
FIG. 7 is a perspective view only illustrating a drum back of FIG. 4 from another view different from the view of FIG. 5.
Figure 8:
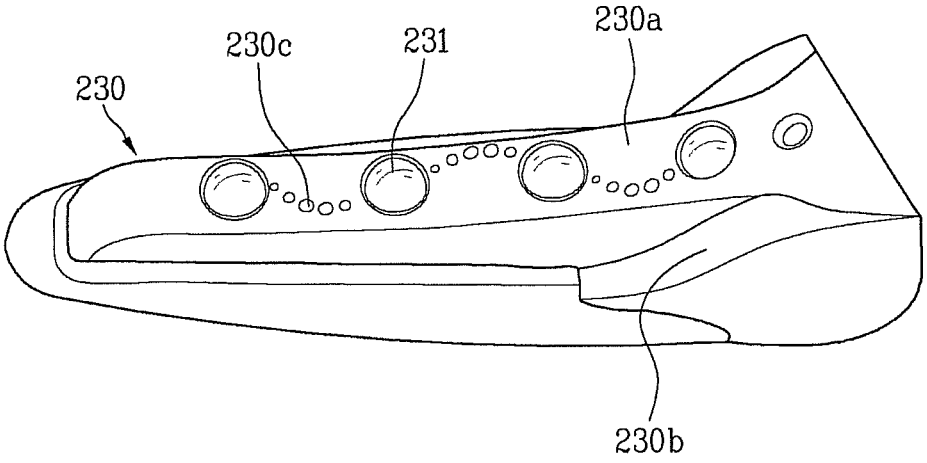
FIG. 8 is a perspective view illustrating the lifter of FIG. 4.
Figure 9:
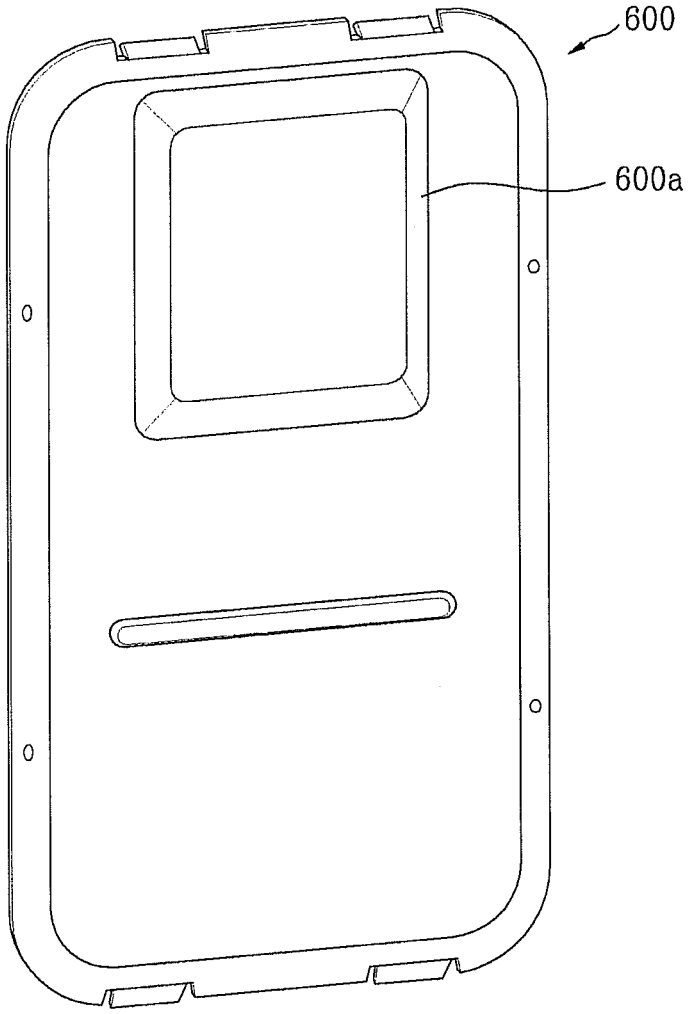
FIG. 9 is a perspective view illustrating a back cover mounted in a rear surface of a cabinet of FIG. 3.

FIG. 7 is a perspective view only illustrating a drum back of FIG. 4 from another view different from the view of FIG. 5. FIG. 8 is a perspective view illustrating the lifter of FIG. 4. FIG. 9 is a perspective view illustrating a back cover mounted in a rear surface of a cabinet of FIG. 3.

A washing machine according to another embodiment of the present invention includes a tub 100 supported in a cabinet inclinedly at a predetermined angle; a drum 200 rotatably mounted within the tub and having a drum front 290, a drum center 280 and a drum back 270; a spider 300 mounted to a rear surface of the drum back 270; and a direct type motor mounted in a rear surface of the tub 100.

The drum back 270 has a bowl shape, and a portion of a bottom surface thereof corresponding to the spider 300 is recessed forwardly enough not to prevent the spider 300 from being projected toward the drum back 270.

At that time, the drum back 270 is connected to a first opening of the drum center 280 having a cylindrical shape for defining a rear surface of the drum 200. Thus, the rear surface of the drum 200 is the rear surface of the drum back 270.

A portion of the drum back 270 where the spider 300 is mounted is recessed inwardly so that the distance between the drum center 280 and the spider 300 may be entirely lessened. Since the entire width of the drum type washing machine in a front-and-rear direction is set forth to be fixed, the distance between the drum center 280 and the spider 300 is set forth to be fixed.

Accordingly, the drum back 270 is entirely bowl-shaped to define the drum expanding part 271, and the portion of the drum back 270 where the spider 300 is mounted can be said to lessen some expanding area of the drum expanding part 271.

Here, the drum back 270 is bowl-shaped to maximize the expanding area of the drum expanding part 271. Thus, it is preferred that the inner diameter of the drum center 280 is actually the same as that of the drum back circumference connected to the first opening of the drum center 280.

Preferably, the circumference of the drum back 270 includes a linear part 273 with a predetermined length which is parallel with the center of the drum 200. Also, preferably, the circumference of the drum back 270 and the rear surface of the drum back 270 are connected in a round shape.

The drum 200 is made of stainless (for example; STS, SGCC, SGCH, SFCH and SECC). The thickness of the drum front 290 and the drum center 280 is 0.5 mm, and the thickness of the drum back 270 is 1 mm.

The ratio (d/D) of the drum back depth (d) to the drum diameter (D) is 0.08~0.2.

Also, the ratio of the drum back depth (d) to the drum center length (L2) is 0.18~0.36, and the ratio of the drum front length (L1) to the drum center length (L2) to the drum back depth (d) is 1:8.3:1.5~1:9.7:2.7.

The drum front 290 is provided so that the entrance of the opening of the drum 200 which has the least diameter in a ring shape is provided in front, compared to the outer circumference of the drum front which has the largest diameter. The forming part 290*a* is inserted forwardly on an oblique surface connected from the entrance of the opening to the outer edge. That is, the drum front expanding part 290*a* is provided on the oblique surface to increase the drum capacity.

A lifter 230 is provided in the drum 200, and the lifter 230 is entirely triangle-shaped where a front part is narrower and a rear part is wider.

Also, the lifter 230 is formed along a center thereof in a front-and-rear direction and includes a ball installing part 230*a* projectedly formed from the a lower surface of the lifter 230 to make a width thereof narrower than the lower surface of the lifter 230, an oblique surface 230*b* of an S-shape formed in a rear of opposite sides of the ball installing part 230*a* and connected to an upper surface of the ball installing part 230*a* from the lower surface of the lifter 230, at least one ball 231 rotatably mounted on the ball installing part 230*a*, and at least one wash-water-through-hole 230*c* formed on the ball installing part 230*a*.

The oblique surface 230*b* guides the laundry dropped by the rotation of the drum 200 to move along itself toward the front thereof, such that the laundry is prevented from being sided in rear of the drum 200. Thus, the lifter 230 is employed for securing space within the drum 200 owing to the inserted part and the oblique surface as well as for guiding the laundry to solve a problem of laundry unbalance.

Meanwhile, a back cover 600 is provided in a rear surface of the cabinet 2 for shutting off the access to a rear side of the drum 200, and a forming part 600*a* is projected toward the rear side of the drum 200 in more than 50% of the section dividing the back cover section. That is, the forming part 600*a* has a larger section than in the related art.

The back cover 600 has a fastening hole and a supporting piece, which are needed in fastening the back cover 600 to the rear surface of the cabinet 2.

A bearing housing (BH) is provided in the rear wall of the tub 100 along a circumferential direction, and the bearing housing disclosed in the invention which the applicant invented and filed (Korean Patent Application No. 10-2003-0086841) has a wrinkled structure.

In connection with the washing capacity expansion of the drum 200 in the drum type washing machine, thickness of a metal basic material defining the drum front 290 or the drum center 280 is 0.5 mm, and thickness of a metal basic thickness defining the drum back 270 is 1 mm. the reasons thereof will be following.

First, in case that the thickness of the metal basic material (STS, SGCC, SGCH, SFCH and SECC) is smaller than 0.5 mm, there may be a problem that the metal material is ripped in injection molding the drum front 290.

Alternatively, in case that the thickness of the metal basic material (STS, SGCC, SGCH, SFCH and SECC) is smaller than 0.5 mm, metal bottoms and etc. of the laundry whiling washing or drying the laundry may be collided against the drum center 280 to increase noise.

Meanwhile, in case that the thickness of the drum back 270 is thick, the cost of material is increased and press pressure is increased. Moreover, assembling the drum 200 is as difficult as the drum 200 is heavy. Since the drum 200 is getting heavy, the tub 100 supporting the drum 200, the fastened portion to the spider 300 and a motor shaft 500 fastened to the spider 300 may have much load.

Thus, to solve the above problems, in the drum type washing machine according to the present invention the thickness of the metal basic material is 0.5 mm in case of the drum front 290 and the drum center 280 and 1 mm in case of the drum back 270.

Of course, the figure of 0.5 mm and 1 mm is taking fudge factor into consideration which can be admitted in the art.

Next, the reasons for the ratio of the drum back depth to the drum center 280 are following.

In case that the drum back 270 is fabricated by pressing and deep drawing, the thickness of the metal basic material has a huge effect on the injection molding. That is, since pressing uses softness of metal material. Thereby, in case that the metal basic material is thin, the drum back 270 may not be molded in a needed appearance to expand the inside of the drum back 270.

Considering the interrelationship between the fact that the drum capacity should be increased within the limited size of the cabinet and the fact that the drum center length for common use with existing parts (for example; with a drum type washing machine having 13 kg capacity) and the drum back expanding depth which will be improved to increase the washing capacity (a drum type washing machine having 15 kg capacity) should be considered, the drum back 270 should be expanded in a predetermined depth but should not be expanded over a predetermined depth to maintain strength thereof.

For that, the present invention has been optimized through many experiments to supply a drum structure for a drum type washing machine having a large capacity capable of maintaining strength even with the maximum expansion of the drum back 270.

As the range for satisfying that, if the ratio (d/D) of the drum back depth (d) to the drum back diameter (D) is 0.08~0.2, the strength which has been wanted may be secured with preventing the metal basic material from being ripped.

If it is assumed that the above ratio would be the ratio of the drum back depth (d) to the drum center length (L2), the ratio is 0.18~0.36 to be safe enough. Also, the ratio of the drum front length (L1) to drum center length (L2) to the drum back depth (d) is 1:8.3:1.5~1:9.7:2.7.

As the preferred embodiment of the present invention, the thickness of the drum front 290 and the thickness of the metal basic material (STS) for the drum center 280 is 0.5 mm. The thickness of the drum back 270 is 1 mm and an internal diameter of the drum center 280 is 560 mm and the drum front length is 36 mm. the drum center length is 328~337 mm and the maximum drum back depth is 80 mm.

It is not limited thereto. Alternatively, the forming part 24 and 240 or the drum expanding part 26 or the tub expanding part 19 may be 2-stepped. Also, the forming part 24 and 240 or the drum expanding part 26 may have a reinforcing bid.

Since it has the forming part of the drum front 290 formed therein, the drum type washing machine according to the present invention may have the forwardly expanded space, unlike the drum front 290 of the related art. That is, an additional space may be secured in the forming part formed along the circumferential direction.

Also, the additional space for increasing washing capacity within the drum 200 may be secured by improving the structure of the lifter, because the portion where the opposite sides of the ball installing part are formed secures some space.

That is, as much space as the opposite sides of the ball installing part are inserted may be secured.

Especially, since the drum back 270 is deeper than that of the related art, the additional space is easily secured. In case that the diameter of the drum 200 is more than 500 mm as described in the above embodiments, even a small increase of the depth may be prominent increase of capacity. That is, if the cross section of the drum back 270 is multiplied by the depth, the volume of the drum back 270 will be calculated. Since the value of the cross section is calculated by multiplying square of radius by the ratio of the circumference of a circle to its diameter ($V=\pi r^2$) and the radius is large, it is possible to secure much additional space actually even with a small increase of the drum back depth.

Owing to the additional space secured by the drum front 290, the lifter 230 and the drum back 270, the drum type washing machine of the present invention may secure much more washing capacity than the one of the related art without the increase of exterior size.

Meanwhile, as the length of the top plate 9 in a front-and-rear direction is the actual depth the exterior depth of the drum type washing machine, the top plate 9 is further backwardly projected than the rear surface of the cabinet by a predetermined value to fastening a bracket which secures the top plate to the cabinet (see FIG. 1).

Thus, when the drum back depth is increased, the rear surface of the cabinet is projected backwardly to avoid the interference with the cabinet and the motor but there may be not change of the exterior size of the drum type washing machine only if the rear surface of the cabinet is not projected to the rear of the top plate.

It is preferred that washing capacity may be increased by each additional space from the drum front 290, the lifter and the drum back 270. However, there is no room where the cabinet is projected backwardly, because the top plate is projected toward the rear of the cabinet. Thus, the washing capacity may be increased without any change of the exterior size of the drum type washing machine, even if only the drum back depth is increased.

Next, a method for fabricating the drum back 270 will be described referring to FIG. 10.

Figure 10:
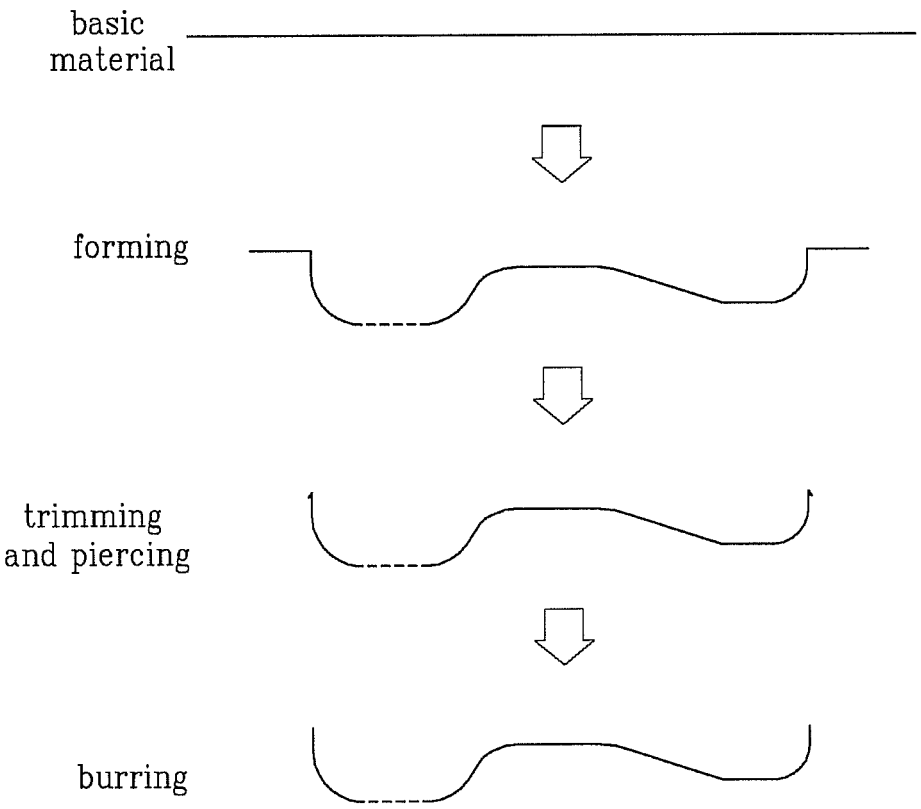
FIG. 10 is a sectional view illustrating a process to describe a method for fabricating the drum back of the drum type washing machine according to the present invention.

FIG. 10 is a sectional view illustrating a process to describe a method for fabricating the drum back 270 of the drum type washing machine according to the present invention. According to the method for fabricating the drum back 270, the basic material (M) made of metal is prepared. Hence, the metal basic material is treated in a pressing process to be bowl-shaped and a predetermined area of a bottom thereof is inserted forwardly in a forming step.

Next, in a trimming step, the other parts except the molding part which will define the drum back 270 is trimmed. Then, in a piercing step, plural holes 270*a* are formed in a portion of the trimmed basic metal material except the portion of the bottom inserted forwardly.

Preferably, the trimming step and the piercing step are performed at the same time.

Also, in the piercing step, a predetermined number of fastening holes 270*b* are formed in the portion of the bottom inserted forwardly.

The diameter of the hole formed in the other portion except the inserted portion is 3 mm.

After the trimming and the piercing, burr remaining in the drum back 270 is removed. Thus, the internal diameter of the drum back 270 molded through the above process is 500~600 mm.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The industrial applicability of the present invention is described in the disclosure of the invention, thereby being omitted herein.

The invention claimed is:

1. A drum type washing machine, comprising:

a cabinet;

a motor including a stator and a rotor;

a drum having a drum center having a cylinder shape and a drum back connected to an opening formed in a first side of the drum center to define a rear surface of the drum;

a tub having the drum rotatably provided therein;

a connector mounted at the rear surface of the drum;

a rotational shaft connected to the connector to transmit a rotational force of the motor to the drum, wherein a portion of the drum back where the connector is mounted is recessed toward an inside of the drum to reduce a distance between the drum center and the connector, wherein the drum and tub are inclined at predetermined angle with respect to a bottom wall of the cabinet such that a rear portion of the drum and the tub are lower than a front portion of the drum and the tub; and a plurality of lifters provided within the drum, each of the plurality of lifters having a ball installing portion formed along a center portion of the respective lifter in a front-to-rear direction and at least one oblique surface provided at the rear portion of the drum that guides laundry toward the front portion of the drum, each oblique surface including S-shape formed at a rear portion of opposite sides of the ball installing portion, and wherein the at least one oblique surface extends from an upper surface of the ball installing portion to a lower surface of the respective lifter.

2. The drum type washing machine of claim 1, wherein an internal diameter of the drum center is the same as an internal diameter of a circumference of the drum back connected to the opening formed in the side of the drum center.

3. The drum type washing machine of claim 2, wherein the circumference of the drum back has a linear portion with a predetermined length, which extends substantially parallel, to the rotational shaft.

4. The drum type washing machine of claim 2, wherein the circumference of the drum back and the tear surface of the drum back are formed in a round shape.

5. The drum type washing machine of claim 1, wherein the connector comprises a spider having a plurality of legs that extends in a radial direction.

6. The drum type washing machine of claim 1, wherein the motor is mounted on the rear surface of the tub to be connected to the rotational shaft, and wherein a portion of the rear surface of the tub where the motor is not mounted is expanded backwardly to form a tub expanding portion.

7. The drum type washing machine of claim 4, wherein the drum is made of stainless steel, and wherein a thickness of a drum front and a thickness of the drum center are 0.5 mm and a thickness of the drum back is 1 mm.

8. The drum type washing machine of claim 7, wherein a ratio (d/D) of a depth (d) of the drum back to a diameter of the drum is 0.08~0.2.

9. The drum type washing machine of claim 7, wherein a ratio (d/L2) of a depth (d) of the drum back to a length (L2) of the drum center is 0.18~0.36.

10. The drum type washing machine of claim 7, wherein a ratio (L1:L2:d) of a length (L1) of the drum front to a length (L2) of the drum center to a depth (d) of the drum back is 1:8.3:1.5~1:9.7:2.7.

11. The drum type washing machine of claim 7, wherein the internal diameter of the drum center is formed within a range of 500~600 mm.

12. The drum type washing machine of claim 4, wherein each of the plurality of lifters have a triangle shape that increases in width from the front portion of the drum toward the rear portion of the drum, and wherein each of the plurality of lifters comprises:

the ball installing portion formed to project from the lower surface of the respective lifter to make a width thereof narrower than the lower surface of the respective lifter;

the at least one oblique surface;

at least one ball rotatable mounted on the ball installing portion; and at least one wash-water-through-hole formed on the ball installing portion.

13. The drum type washing machine of claim 4, further comprising:

the cabinet, which forms an exterior of the drum type washing machine; and a back cover that shuts off access to a rear side of the drum from a rear side of the cabinet, the hack cover having a projection portion that projects backwardly at an upper portion thereof.

14. The drum type washing machine of claim 4, wherein the drum further comprises:

a drum front connected to a second side of the drum center to form an opening of the drum, and wherein the drum front comprises:

a front minimum internal diameter portion;

a rear maximum internal diameter portion; and an oblique portion that connects the front minimum internal diameter portion and the rear maximum internal diameter portion.

15. The drum type washing machine of claim 14, wherein a drum front expanding portion that expands in a forward direction is formed in the oblique portion.

16. A drum type washing machine, comprising:

a cabinet;

a motor including a stator and a rotor;

a drum having a drum center having a cylinder shape and a drum back connected to an opening formed in a side of the drum center to define a rear surface of the drum;

a tub having the drum provided therein;

a connector mounted at the tear surface of the drum;

at least one lifter provided within the drum; and a rotational shaft connected to the connector to transmit a rotational force of the motor to the drum, wherein a portion of the drum back where the connector is mounted is recessed toward an inside, of the drum to reduce a distance between the drum center and the connector, wherein the drum and the tub are inclined at a predetermined angle with respect to a bottom wall of the cabinet such that a rear portion of the drum and the rub are lower than a front portion of the drum and the tub, and wherein the at least one lifter has a ball installing portion formed along a center portion of the lifter in a front-to-rear direction and at least one oblique surface provided in the rear portion of the drum that guides laundry toward the front portion of the drum, each oblique surface including an S-shape formed at a rear portion of opposite sides of the ball installing portion, and wherein the at least one oblique surface extends from an upper surface of the ball installing portion to the lower surface of the lifter.

17. The drum type washing machine of claim 16, wherein a plurality of fastening holes are formed in the recessed portion of the drum back opposite to the at least one lifter to fasten the connector to the drum back, and wherein an expanding portion is located adjacent the at least one lifter, such that a larger washing capacity is obtained without an increase in exterior size of the drum.

* * * * *